US005431078A

United States Patent [19]

Ricard et al.

[11] Patent Number: 5,431,078

[45] Date of Patent: Jul. 11, 1995

[54] APPARATUS FOR SLICING A FOOD ARTICLE

[75] Inventors: Paul J. Ricard; Robert A. Cann, both of Amherst, Mass.

[73] Assignee: Good Idea! Inc., Northampton, Mass.

[21] Appl. No.: 199,526

[22] Filed: Feb. 22, 1994

[51] Int. Cl.[6] ..... B26D 7/02

[52] U.S. Cl. ..... 83/870; 83/454; 83/544; 83/697; 83/932

[58] Field of Search ..... 83/870, 454, 466.1, 83/544, 613, 636, 697, 761, 762, 932; 269/87.2, 295; 30/114, 124, 136.5, 289, 290, 294, 305, 315

[56] References Cited

U.S. PATENT DOCUMENTS

| | | | |
|---|---|---|---|
| D. 279,156 | 6/1985 | Levine | D7/43 |
| 364,641 | 6/1887 | Gathmann | 83/613 |
| 495,999 | 4/1893 | Quigg | 83/544 |
| 689,687 | 12/1901 | Newcome | 30/294 X |
| 751,695 | 2/1904 | Smithwick | 83/697 |
| 937,611 | 10/1909 | Kawasaki | 83/466.1 |
| 1,964,457 | 6/1934 | Diamond | 83/636 |
| 2,481,162 | 9/1949 | Seely | 83/544 |
| 2,685,901 | 8/1954 | Putzer | 83/870 |
| 3,338,282 | 8/1967 | Blum . | |
| 3,347,296 | 10/1967 | Rothman . | |
| 4,218,946 | 8/1980 | Witzler | 83/636 |
| 4,249,445 | 2/1981 | Browning | 83/762 |
| 4,399,989 | 8/1983 | Baillie | 269/87.2 |
| 4,546,686 | 10/1985 | Losiowski et al. | 83/874 |
| 4,580,343 | 4/1986 | Bell, Jr. | 30/114 |
| 4,589,206 | 5/1986 | Marcoux | 30/114 |
| 4,608,896 | 9/1982 | Topp | 83/697 X |
| 4,747,331 | 5/1988 | Policella | 83/761 |
| 4,807,862 | 2/1989 | Popeil et al. | 269/87.2 |
| 4,948,106 | 8/1990 | Popeil et al. | 269/87.2 |
| 5,287,784 | 2/1994 | Brockett | 83/762 |

*Primary Examiner*—Eugenia Jones
*Attorney, Agent, or Firm*—William C. Crutcher

[57] ABSTRACT

A bagel slicer comprising a food holder having a receptacle for holding a bagel, and a blade holder with a blade, a handle and a pair of blade guarding walls. The food holder has a base and a pair of spaced vertical receptacle walls extending upwardly from the base forming a pair of opposed vertical slots. The blade holder has a handle, a pair of spaced transparent blade guarding walls surrounding and guided along the vertical walls of the food holder, and a blade having a pair of serrated cutting edges intersecting one another. The blade is arranged and dimensioned to ride in the vertical slots and to traverse the central part of the receptacle when the handle is vertically actuated to slice the food article. The bagel is held by a cradle which has blade protection lips to guard the blade cutting edge at the lower travel limit.

13 Claims, 3 Drawing Sheets

APPARATUS FOR SLICING A FOOD ARTICLE

BACKGROUND OF THE INVENTION

This invention relates generally to apparatus for slicing food articles, particularly baked goods such as bagels, doughnuts and the like, and is particularly adapted for slicing bagels. A number of machines and devices for slicing bagels have been proposed in the prior art. These generally comprise holding jigs or receptacles into which the bagel is placed to hold it during a conventional knife cutting operation. A well documented type of bagel holder includes a pair of opposed slots into which is inserted a cutting instrument with a serrated edge, which is moved back and forth with a to-and-fro sawing action to slice the bagel while it is held by the receptacle. In some cases, the receptacle includes multiple opposed slots for making multiple slices. Other types of apparatus include a knife blade attached to the housing to facilitate the sawing action, and sometimes provision is made for also rotating the bagel to facilitate slicing. Because of the movement of the bagel to and fro due to the sawing action, it may be necessary to include tapered walls or moveable side doors to hold the bagel to prevent damage to it while being sliced. The use of a separate knife to slice the bagel is not always convenient and presents the possibility of injury from the knife blade. Also, in commercial operations such as restaurants, speed, safety, cleanliness and uniform bagel slicing are all requisites. Another known type of bagel slicer pushes a bagel past fixed blades and is designed for horizontal use where ample counter space and a counter edge are available.

Accordingly, one object of the present invention is to provide an improved apparatus for slicing food articles, particularly baked goods in a uniform, quick and safe manner.

Another object of the invention is to provide an improved bagel slicer using a minimum of space which facilitates the slicing operation without damage to the bagel.

Another object of the invention is to provide an improved bagel slicer which is efficient, quick, clean and safe.

SUMMARY OF THE INVENTION

Briefly stated, the invention comprises two parts, a food holder having a receptacle for holding a food article such as a bagel, and a blade holder with a blade, a handle and a pair of blade guarding walls. The food holder has a base and the receptacle is defined by a pair of spaced vertical receptacle walls extending upwardly from the base, the walls defining between them a pair of opposed vertical slots. The blade holder has a handle and a pair of spaced blade guarding walls guided along the vertical walls of the food holder, and a blade having a pair of serrated cutting edges intersecting one another. The blade also has a pair of opposed side edges held in between the spaced blade guarding walls in the handle, the blade being arranged and dimensioned to ride in the vertical slots and to traverse the central part of the receptacle when the handle is vertically actuated to slice the food article. Preferably the blade holder is constructed as a transparent enclosure which guards the blade while still revealing it to reduce chance of injury. The enclosure is adapted to envelop the vertical receptacle walls as the blade traverses the receptacle. The bagel is held by a cradle which also guards the blade cutting edge at the lower travel limit.

DRAWING

The subject matter which is regarded as the invention is particularly pointed out and distinctly claimed in the concluding portion of the specification. The invention, however, both as to organization and method of practice, together with further objects and advantages thereof, may best be understood by reference to the following description, taken in connection with the accompanying drawings, in which:

FIG. 1 is a perspective view of the bagel slicer comprising the blade holder separated from the food holder, FIG. 2 is a horizontal elevation end view of the food holder, FIG. 3 is a horizontal elevation side view, in cross section, taken along the vertical plane III—III passing through the center of the food holder of FIG. 2, FIG. 4 is a horizontal elevation end view of the blade holder, FIG. 5 is a horizontal elevation side view, in cross section taken along the vertical plane V—V passing through the center of the blade holder of FIG. 4, FIG. 6 is a top plan view of the assembly of food holder and blade holder, taken in cross section along horizontal plane VI—VI of FIG. 1 below the handle, and FIG. 6*a* is a fragmentary top plan view of a modified form of blade holder.

DESCRIPTION OF THE PREFERRED EMBODIMENT

Figure 1:
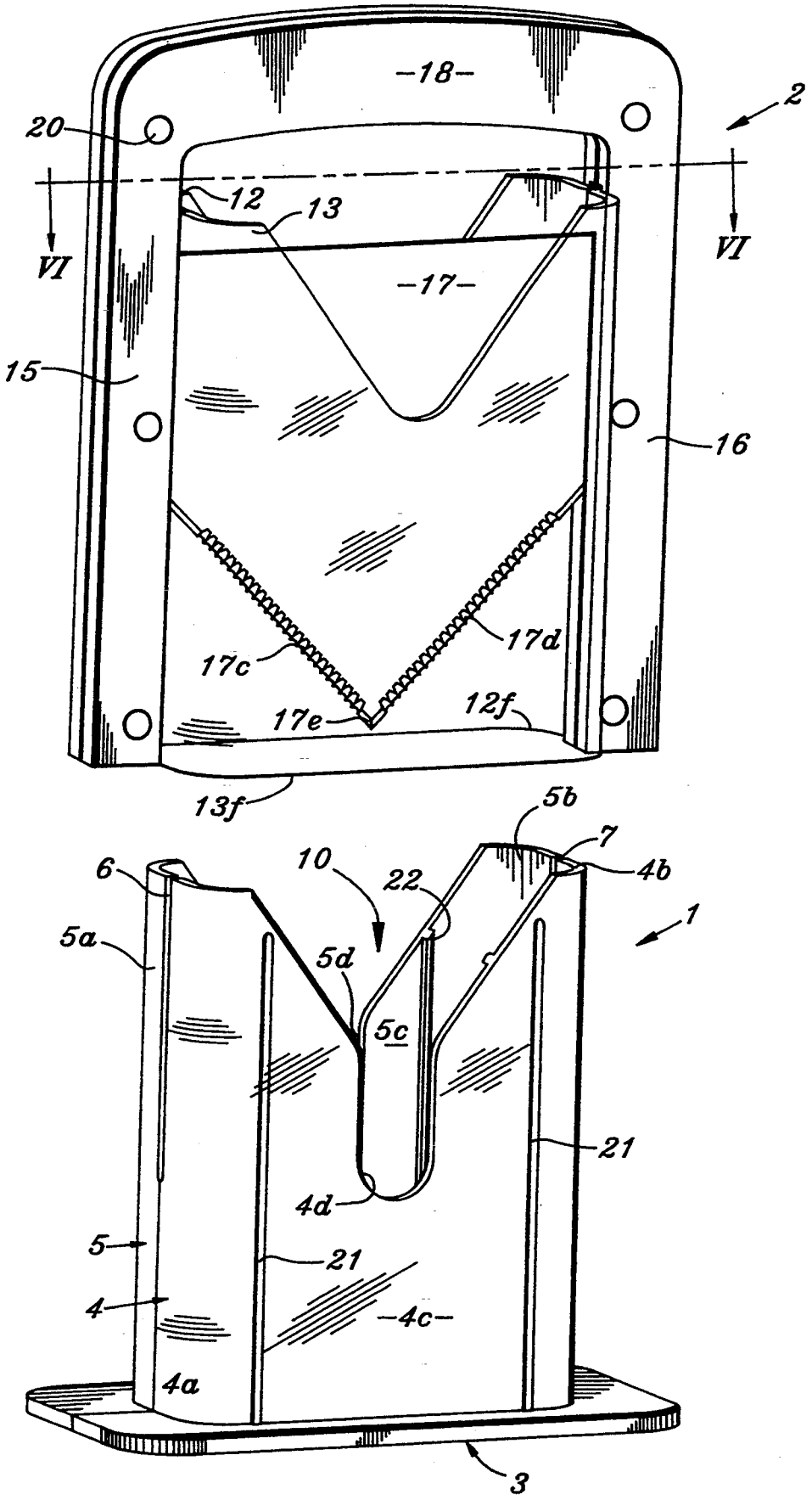
Figure 2:
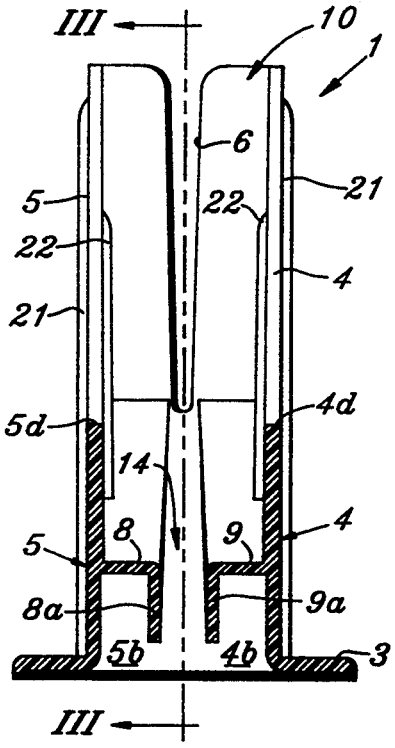

Referring to FIG. 1 of the drawing, the bagel slicer, shown in perspective view, comprises a food holder shown generally as 1, and a blade holder shown generally as 2. Food holder 1 includes a flat substantially rectangular base 3 for supporting the bagel slicer on a table or the like. Extending upwardly from base 3 are a pair of curved vertical receptacle walls 4, 5, which are separated from one another to form a pair of opposed vertical slots 6, 7. Walls 4, 5 may be joined together near the base to provide rigidity. Wall 4 includes a pair of spaced end parallel wall portions 4*a*, 4*b* and a sidewall portion 4*c* contoured on the top edge to provide a finger slot extension 4*d* in the center. Wall 5 comprises vertical parallel spaced end wall portions 5*a*, 5*b*, and a connecting sidewall portion 5*c* with top edge contoured to provide finger slot extension 5*d* which is also spaced and parallel to sidewall portion 4*c*. Four external vertical tracking ribs 21 are molded in the sidewall portions 4*c*, 5*c*. Transverse wall portions 8, 9, as best seen in FIG. 2, together form food cradle wall portions disposed above the base 3, and include depending blade protection lips 8*a*, 9*a*. The food holder 1 may be a single plastic molding with walls 4, 5, 8, 9 and base 3 molded as a single piece or it may be manufactured, as shown, in two identical halves and joined together by an adhesive or by ultrasonic welding.

Figure 3:
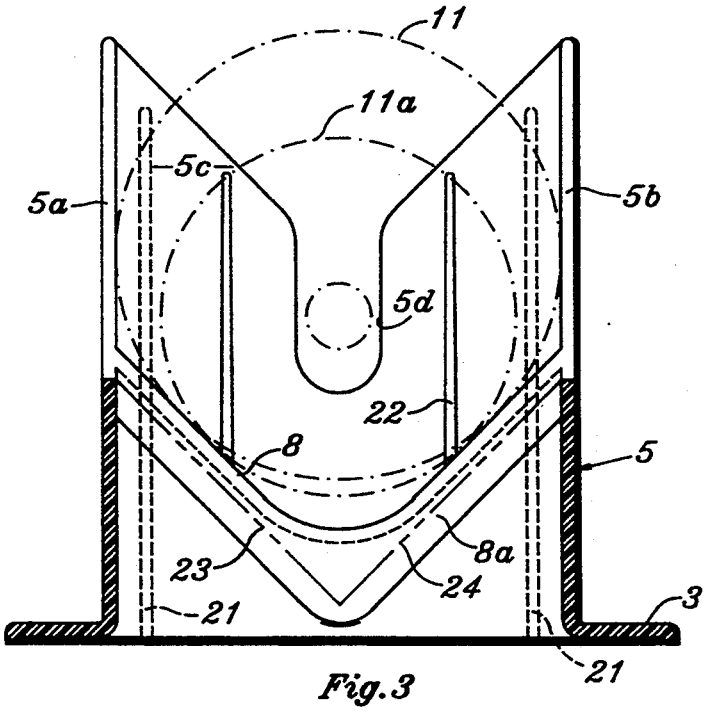

The vertical walls 4, 5 and the food cradle wall portions 8, 9 together define a receptacle 10 of proper size and shape to receive a food article such as a bagel 11 shown in dot-dash lines. Four internal food centering ribs 22 are molded into vertical walls 4, 5 to assist in centering smaller food articles such as the smaller bagel 11*a* shown in dot-dash lines. The transverse food cradle wall portions 8, 9 slope downwardly from the end walls and converge at the center of the bagel slicer as indicated in FIG. 3, so that the bagel is automatically centered in receptacle 10. The food cradle wall portions 8, 9 are separated by a cradle slot 14 to receive the blade cutting edges. Cradle slot 14 is wider in the center than at the ends.

Figure 4:
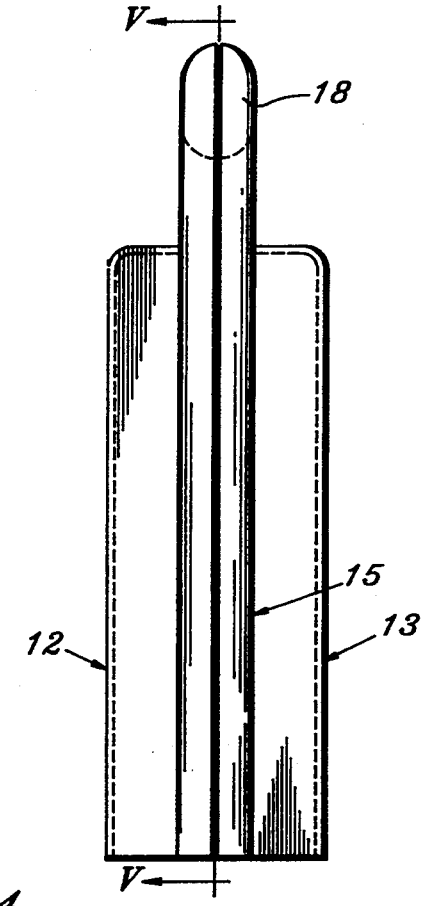
Figure 5:
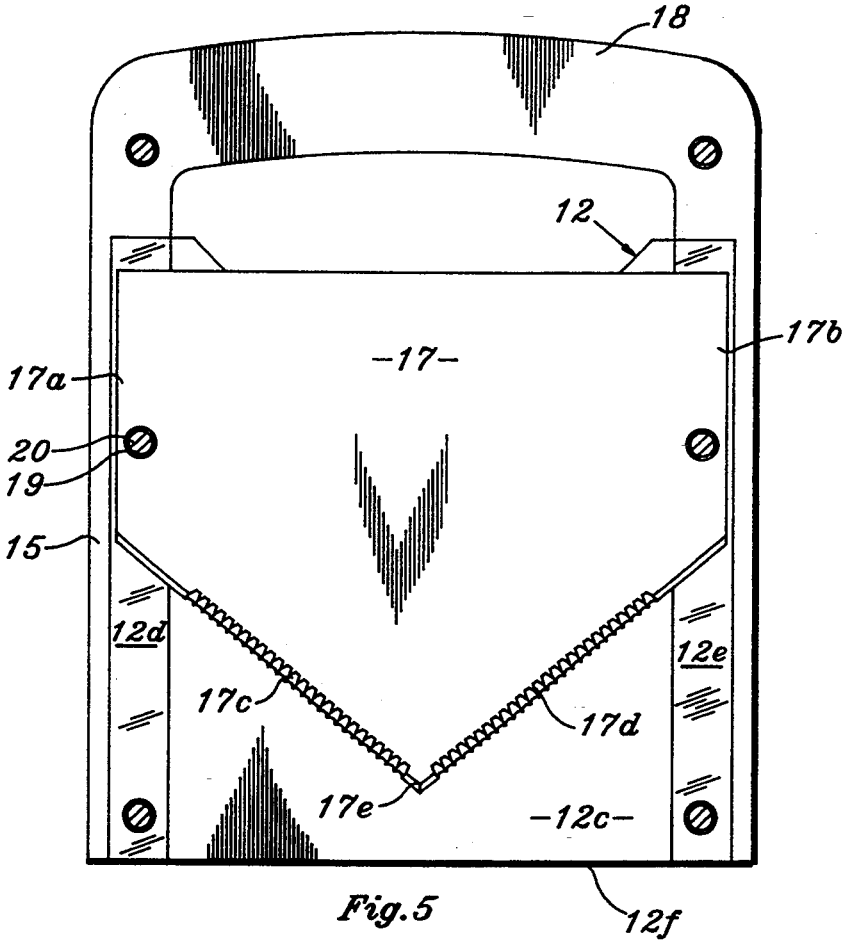

The other operative component of the bagel slicer is the blade holder 2. Referring to FIGS. 1, 4 and 5, blade holder 2 comprises a pair of spaced transparent blade guarding walls 12, 13 which are parallel to one another. The blade guarding walls 12, 13 have spaced parallel end wall portions 12*a*, 12*b*, 13*a*, 13*b* and curved sidewall portions 12*c*, 13*c* with bottom edges 12*f*, 13*f*. Flanges 12*d*, 12*e*, 13*d*, 13*e* are provided which fit inside vertical legs 15, 16 and support a blade 17 between them. Legs 15, 16 are connected to an operating handle 18.

Handle 18 may be molded together with legs 15, 16 as a single piece, or handle and legs may be manufactured as shown in two identical U-shaped halves and held together by rivets 20.

Referring to FIG. 5 of the drawing, the blade 17 is shown to comprise a pair of side edges 17*a*, 17*b* and a pair of serrated cutting edges 17*c*, 17*d* intersecting one another in a point 17*e* near the center of the blade. Side edges 17*a*, 17*b* are provided with holes 19. The side edges 17*a*, 17*b* are held between the halves of legs 15, 16 and between the flanges 12*d*, 12*e* and 13*d*, 13*e* of guard walls 12, 13 respectively by rivets 20 passing through holes 19.

The serrated cutting edges preferably intersect one another at an included angle of 90° although other included angles are possible without departing from the scope of the invention. Larger included angles make the unit more compact but may reduce slicing effectiveness. Small included angles may increase slicing effectiveness, but may make the unit too tall. Furthermore, although the serrated edges 17*c*, 17*d* are preferably straight, they may also be slightly concave or convex and still perform in a satisfactory manner. Preferably there are two distinct cutting edges meeting in a point which pierces the center of the bagel. The cutting edges 17*c*, 17*d* are made up of serrations or teeth extending from the cutting edges. The teeth are relatively coarse and large. Satisfactory performance has been obtained with teeth approximately one-eighth ($\frac{1}{8}$) inch long and having a tooth spacing or pitch of approximately one-eighth ($\frac{1}{8}$) inch. The blade material is preferably stainless steel and a satisfactory blade thickness is 24 gauge material with the teeth ground to provide cutting edges in a manner well known in the art.

Figure 6:
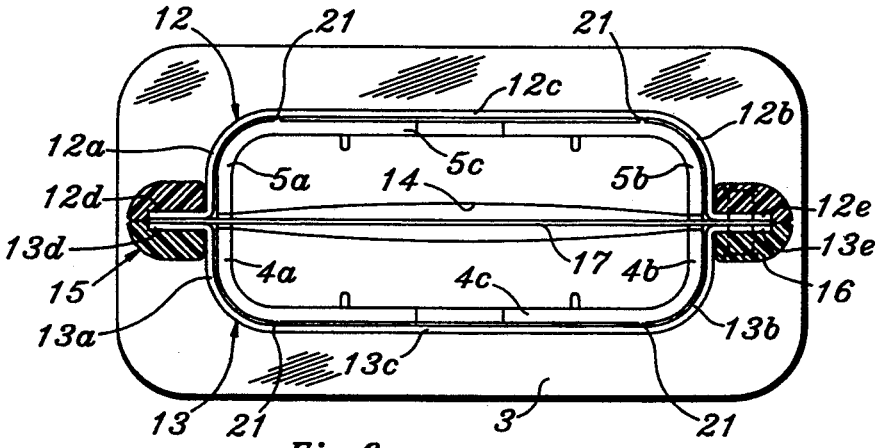

Referring to FIG. 6 of the drawing, the blade guarding walls 12 and 13 of blade holder 2 are seen to provide an enclosure which envelops the vertical receptacle walls 4 and 5 of the food holder 1 and engages the four tracking ribs 21, which serve to guide vertical movement of blade holder 2.

Referring to FIG. 3 of the drawing, the travel limits of the blade 17 with respect to the food holder 1 are indicated with dot dash line fragments 23, 24 showing the lower limiting position of blade cutting edges 17*c*, 17*d*. The blade cutting edges pass through the slot between cradle wall portions 8, 9. The cradle wall blade protection lips 8*a*, 9*a* are of sufficient length and proper shape to prevent injury from the cutting edges of the blade at its lower travel limit.

Referring to FIG. 1, it will also be observed that the bottom edges 12*f*, 13*f* of the blade guarding walls extend beyond the point 17*e* of the blade and the blade cutting edges 17*c*, 17*d* lie totally within the enclosure defined by the blade guarding walls. Therefore bottom edges 12*f*, 13*f* will encounter a foreign object and stop the blade holder 2 before the blade can cut the foreign object, provided that the foreign object lies in the path of one of said bottom edges 12*f*, 13*f* as the blade holder 2 descends.

OPERATION OF THE INVENTION

In operation, a bagel 11 is placed in receptacle 10 and supported on the food cradle wall portions as indicated in FIG. 3. Undersize bagels 11*a* are centered transversely, as well, by the internal centering ribs 22, which also will permit passage of normal size and oversize bagels. Blade holder 2 is positioned directly above the food holder 1 so that blade guard walls 12, 13 surround receptacle walls 4, 5, and moved vertically downward, with the blade holder walls guided vertically by the tracking ribs 21. The downward movement of blade 17 causes the point 17*e* at the intersection of cutting edges 17*c*, 17*d* to pierce the center of the bagel, which is held centered by the food cradle wall portions 8, 9. The set-rations sever the bagel with a simple downward stroke without to-and-fro sawing action used by prior art bagel slicers. The blade holder 2 is lifted again by handle 18 and the sliced and cradled bagel 11 is removed, this being facilitated by the contoured finger slots 4*d*, 5*d* of the food holder, which extend down the walls 4*c*, 5*c* in the center to permit grasping the bagel by the center hole with a finger and removing it.

MODIFICATIONS

Figure 6A:
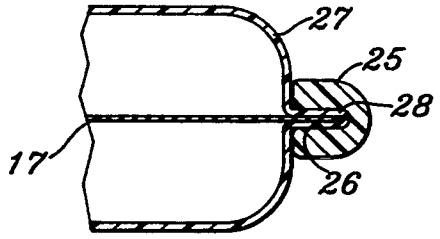

Many alternative means of attaching blade 17 to the blade holder and other methods of constructing the blade guarding walls are possible. FIG. 6*a* illustrates such modifications. If the blade handle is molded in one piece of plastic, the legs shown at 25 are provided with slots 26 to receive flanges of the blade guarding walls and blade side edges. In this case the blade guarding wall may also be molded as a single transparent plastic member 27 with a slotted flange 28 holding the blade 17. Also, the side edges of the blade may be over-molded with plastic extruded through holes 19 at the time of a handle molding process. Alternatively, the blade and guarding wall flanges may be clamped between two identical handle halves which can be of any suitable material, such as wood, plastic or metal, with any one of a variety of conventional attachment means.

While the preferred apparatus includes slotted sidewalls for the receptacle, it is within the scope of the invention to design the blade holder 2 so that it slides inside rather than outside the food holder 1, in which case slotted sidewalls for passage of the blades would not be required.

The term "vertical" used herein is used for ease of description with reference to the normal manner of use, with food holder resting upon the base, and is not intended to be limiting. For example, the device may be operated on its side, in which case the term "horizontal" is implied in place of "vertical".

While there is disclosed what is considered to be the preferred embodiment of the invention, other modifications will occur to those skilled in the art and it is desired to secure in the appended claims all such modifications as fall within the true spirit and scope of the invention.

We claim:

1. Slicing apparatus for a food article, comprising a food holder having a base and a receptacle for holding said food article, said receptacle defined by a pair of spaced vertical receptacle walls extending upwardly from said base, said receptacle walls defining a pair of opposed vertical slots, a blade having a pair of serrated cutting edges intersecting one another near the center of said blade, and having a pair of side edges, said blade being arranged and dimensioned to ride in said vertical slots so as to traverse the central part of said receptacle when said blade is vertically actuated to slice said food article, and a blade holder having a handle connected to said blade, said blade holder including a pair of spaced blade guarding walls attached to said blade side edges to define an enclosure for said blade and adapted to be guided in vertical movement so as to envelop said vertical receptacle walls as the blade traverses the receptacle.

2. Combination according to claim 1, including a plurality of vertical tracking ribs defined by wall portions molded in said receptacle walls and arranged to guide said blade guarding walls as the blade traverses said receptacle.

3. Combination according to claim 1, wherein said blade guarding walls define a pair of opposed flange portions and wherein said blade side edges are held between said flange portions.

4. Combination according to claim 3, wherein said handle comprises a U-shaped member having a pair of spaced legs adapted to receive said opposed flange portions and said blade side edges.

5. Slicing apparatus for a food article, comprising a food holder having a base and a receptacle for holding said food article, said receptacle defined by a pair of spaced vertical receptacle walls extending upwardly from said base, a blade holder having a handle and a pair of spaced blade guarding walls defining an enclosure and adapted to be guided in vertical movement by said vertical receptacle walls, and a blade mounted to said blade holder and disposed between said blade guarding walls, said blade having a pair of blade cutting edges intersecting one another near the center of said blade, and having a pair of side edges connected to said blade guarding walls, said blade being arranged and dimensioned to traverse the central part of said receptacle when said handle is vertically actuated to slice said food article, and wherein said food holder includes food cradle wall portions extending transversely from said vertical receptacle walls above said base, said food cradle wall portions defining a cradle slot between them for receiving said blade cutting edges and wherein said food cradle wall portions further define downwardly extending blade protection lips on either side of said cradle slot.

6. Combination according to claim 5, wherein said blade cutting edges intersect with an included angle of approximately 90°.

7. Combination according to claim 5, wherein said blade cutting edges comprise coarse serrated teeth approximately % inch long with a tooth pitch of approximately ⅛ inch between teeth.

8. Combination according to claim 5, wherein said spaced blade guarding walls have respective spaced bottom edges defining the lower extent of said enclosure, and wherein said blade cutting edges are disposed totally within said enclosure, whereby said bottom edges will intercept a foreign object lying in the path of a said bottom edge to prevent the blade cutting edges from striking the foreign object.

9. Slicing apparatus for a food article, comprising a food holder having a base and a receptacle for holding said food article, said receptacle defined by a pair of spaced vertical receptacle walls extending upwardly from said base, said receptacle walls defining a pair of opposed vertical slots, a blade holder having a handle and a pair of spaced blade guarding walls defining an enclosure and adapted to be guided in vertical movement by said vertical receptacle walls, and a blade mounted to said blade holder and disposed between said blade guarding walls, said blade being arranged and dimensioned to ride in said vertical slots, said blade having a pair of blade cutting edges intersecting one another near the center of said blade and having a pair of side edges connected to said blade guarding walls, said blade being arranged and dimensioned to traverse the central part of said receptacle and said enclosure being adapted to envelop said vertical receptacle walls as the blade traverses the receptacle when said handle is vertically actuated to slice said food article, and wherein said food holder includes food cradle wall portions extending transversely from said vertical receptacle walls above said base, said food cradle wall portions defining a cradle slot between them for receiving said blade cutting edges.

10. Combination according to claim 9, including a plurality of vertical tracking ribs defined by wall portions molded in said receptacle walls and arranged to guide said blade guarding walls as the blade traverses said receptacle.

11. Combination according to claim 9, wherein said blade guarding walls define a pair of opposed flange portions and wherein said blade side edges are held between said flange portions.

12. Combination according to claim 11, wherein said handle comprises a U-shaped member having a pair of spaced legs adapted to receive said opposed flange portions and said blade side edges.

13. Slicing apparatus for a food article, comprising a food holder having a base, a pair of spaced vertical receptacle walls extending upwardly from said base and defining a pair of opposed vertical slots therebetween, and having food cradle wall portions extending transversely toward one another from said vertical receptacle walls and sloping downwardly from said opposed slots, and defining a cradle slot therebetween, said receptacle walls and said cradle wall portions together defining a receptacle for holding a food article centered in said receptacle, a blade having a pair of serrated cutting edges intersecting one another at substantially 90° near the center of the blade, and having a pair of side edges, said blade being arranged and dimensioned to ride in said vertical slots to traverse the central part of said receptacle and to cause said cutting edges to enter said cradle slot when said blade is vertically actuated to slice the food article, and a blade holder connected to the side edges of said blade and having a handle and a pair of spaced blade guarding walls, said handle comprising two mating U-shaped members each comprising two spaced leg halves and a connecting handle half, said blade guarding walls comprising a pair of mating transparent plastic members, each said plastic .member having a pair of flanges, each one of the flanges of one plastic member being opposed to one of the flanges of the other plastic member, said opposed flanges adapted to be connected together to form a transparent enclosure, and means attaching said leg halves and said opposed flanges on either side of said blade side edges to provide said transparent enclosure for said blade, whereby said blade holder is placed over said food holder with the blade in the opposed vertical slots, and actuated vertically to sever said food article.

* * * * *

UNITED STATES PATENT AND TRADEMARK OFFICE

CERTIFICATE OF CORRECTION

PATENT NO. : 5,431,078

DATED : July 11, 1995

INVENTOR(S) : Ricard et al.

It is certified that error appears in the above-indentified patent and that said Letters Patent is hereby corrected as shown below:

Column 5, line 63, delete "%", and insert --1/8--.

Signed and Sealed this

Twenty-ninth Day of August, 1995

*Attest:*

Bruce Lehman

BRUCE LEHMAN

*Attesting Officer*

*Commissioner of Patents and Trademarks*